United States Patent [19]

Dustmann

[11] 4,034,535

[45] July 12, 1977

[54] BUILDING SET FOR A BASE CONSTRUCTION OF A PILLAR CASING

[75] Inventor: Heinrich Dustmann, Dortmund-Kruckel, Germany

[73] Assignee: Dula-Werke Dustmann & Co., Dortmund, Germany

[21] Appl. No.: 597,958

[22] Filed: July 21, 1975

[30] Foreign Application Priority Data

July 29, 1974 Germany ..... 258314

[51] Int. Cl.² ..... E04C 3/30

[52] U.S. Cl. ..... 52/727; 52/280; 52/282; 52/481; 52/486; 52/731

[58] Field of Search ..... 52/36, 280, 287, 243, 52/479–481, 727, 731, 239, 241, 486, 488, 282

[56] References Cited

U.S. PATENT DOCUMENTS

| | | | |
|---|---|---|---|
| 1,789,102 | 1/1931 | Jorgensen | 52/282 X |
| 3,143,165 | 8/1964 | Lewis et al. | 52/731 X |
| 3,413,775 | 12/1968 | Katz | 52/727 |
| 3,513,606 | 5/1970 | Jones | 52/243 |
| 3,521,047 | 7/1970 | Smith | 52/282 |
| 3,621,635 | 11/1971 | DeLange | 52/486 |

*Primary Examiner*—Alfred C. Perham
*Attorney, Agent, or Firm*—Burgess, Dinklage & Sprung

[57] ABSTRACT

Construction for panel covering of structural columns.

11 Claims, 7 Drawing Figures

BUILDING SET FOR A BASE CONSTRUCTION OF A PILLAR CASING

BACKGROUND

The invention concerns component parts for a pillar facing framework having vertical corner channels for the accommodation of facing panels.

In department stores or the like, it is often desired to face rectangular or round concrete pillars with panels of plastic or the like, a polygonal, usually square cross section being generally chosen.

Hitherto, it has been the practice to assemble two corner channels, which can simultaneously serve for the attachment of shelf parts, by means of cross members to form tabular frames; these frames can be assembled at the factory, and then on the worksite two such frames with a total of four corner channels are assembled by the attachment of additional cross members to form a total of four tabular frames surrounding the pillar, these being affixed to the pillar by means of furring provided between the cross members and the pillar, whereupon the actual face panels are fastened to these four frames, for example by hanging them from the cross members. This construction requires very expensive assembly work due to the need to attach cross members to the corner channels by screwing them to the flanges of the channels. It is also especially disadvantageous that in the known construction or method it is very easy for the individual panels to get out of square with one another, and very often they have a racked appearance.

It is also known to join ordinary shelf standards equipped with shelf bracket slots on at least four sides by means of cross members fitted into these bracket slots to form frames surrounding the pillar, and then to fasten the facing panels to the cross members of these frames, the outside bracket slots of the shelf standard being masked by additional members. Here again, there is no precise squaring method, special measures are required for the masking of the shelf bracket slots in the shelf standards, and, above all, this known design provides no means for height adjustment at the baseboards and top fillers.

THE INVENTION

It is the object of the invention to create a system that will be easy to assemble, will assure precise squaring between the individual face panels, and above all will permit easy height adjustment at the baseboards and top fillers.

In a framework for a pillar facing of the kind initially described, this object is achieved by the invention by means of sliding blocks which can be joined to the corner channels in a longitudinally or vertically displaceable manner, and which, with cross members affixable to them, will form at least two horizontal frames spaced vertically above one another and surrounding the pillar, or will serve for the adjustment of the height of the corner channels by resting on the floor or on a base element or for the fastening or mounting of a top filler extending around the pillar.

This construction affords an amazingly simple assembly, in that the sliding blocks can be affixed to the corner channels at the factory at the correct position to form the two horizontal frames, and the sliding blocks additionally required for a base or top filler can be pre-installed; then, at the construction site, all that is needed is to mount the cross members on the sliding blocks to form the horizontal frames, in which case a partial preassembly can, again, be performed at the factory.

An especially advantageous and simple embodiment of the invention will result if each corner channel is provided on the interior with two confronting longitudinal flanges between which each sliding block can be locked at any vertical position by means of a bolt which passes through the block and a back plate into which the bolt can be screwed and which engages the longitudinal flanges from the opposite side.

The sliding block is able by means of lateral projections to engage corresponding grooves in the corner channel, resulting in a secure support on the corner channel such that a precise squaring between the individual face panels will result if, in further development of the invention, the cross members are designed to be fitted matingly onto the lugs of the sliding block, which is constructed as a corner bracket, and to be affixed to the said lugs.

Spring pins can be provided as fastening means between the lugs of the corner bracket and the cross members.

The invention will be further explained by way of example with the aid of the drawing, wherein.

Figure 1:
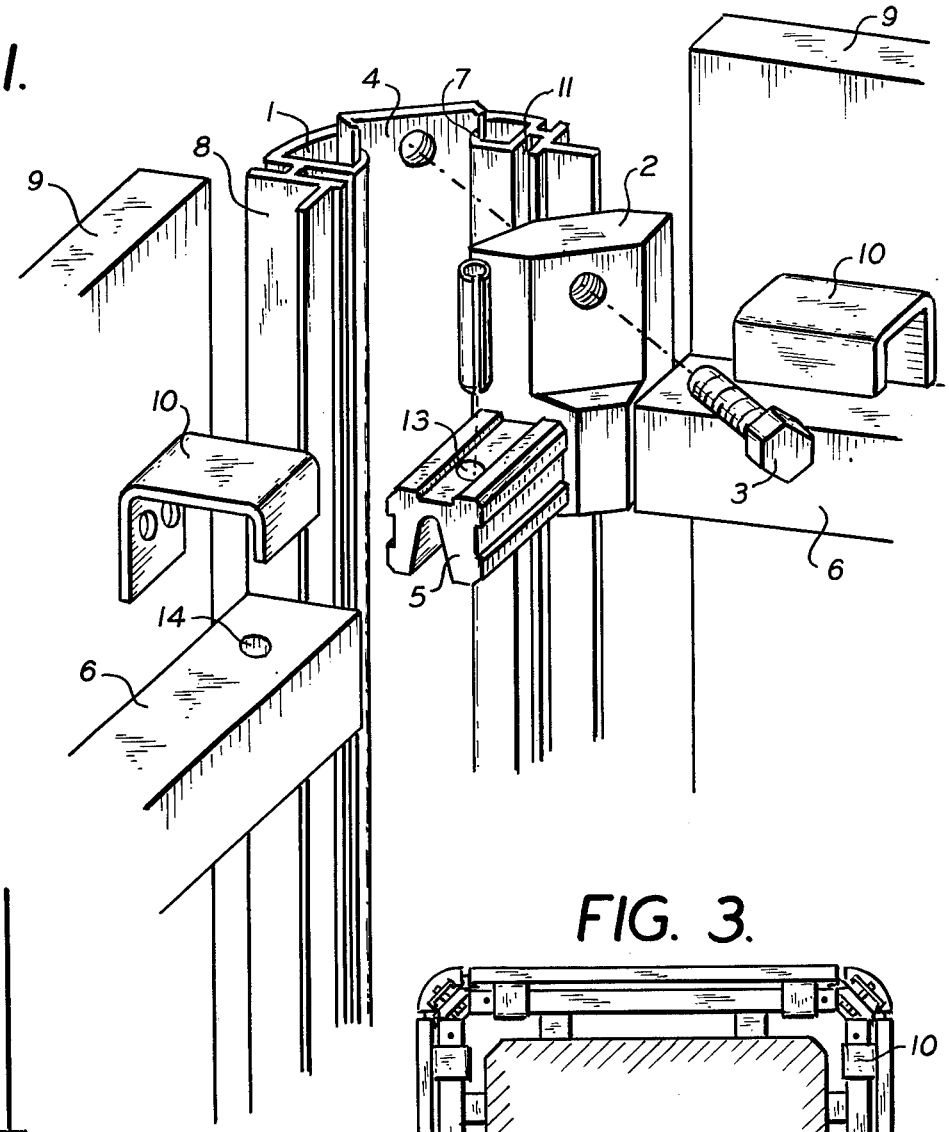
FIG. 1 is an exploded view of a corner of a framework of the invention.
Figure 3:
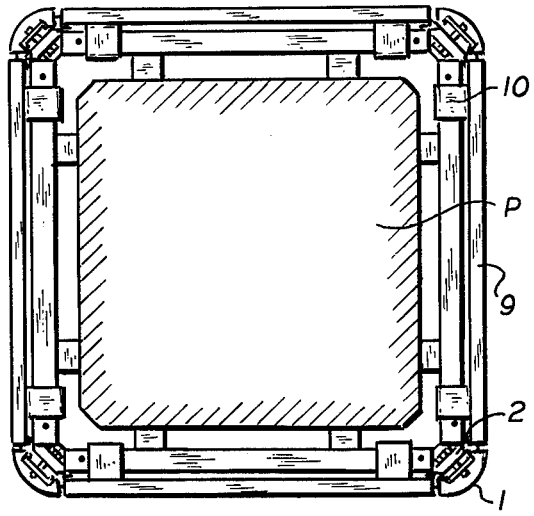
FIG. 3 is a horizontal cross section taken through a pillar faced in accordance with the invention.

The essential parts of the framing are the corner channels 1 of essentially quarter-round cross section, the cross members 6 in the form of tubes of square cross section, and the sliding blocks in the form of corner brackets 2 with bolt 3, back plate 4 and the lugs 5 of special cross-sectional profile which enclose a right angle and fit matingly into the ends of the cross members 6.

The corner channels are constructed internally with two confronting longitudinal flanges 7 which are engaged by the back plate 4.

Furthermore, the corner channels are provided on both sides with angular recesses 8 for the face panels 9 which can be suspended from the cross members 6 by means of hooks 10. Adjacent the recesses 8 in corner channels 1 there are also provided grooves 11 separated by a slotted web to accommodate shelf brackets (not shown) which can be mounted on the pillar. Projections 12 are formed on the sliding block, which engage these grooves 11 on the inside such that the sliding blocks are held securely against rotation by these projections, thereby precisely defining the angle between the individual cross members 6.

Finally, vertical bores 13 are provided in the lugs 5 of the sliding block 2, and corresponding bores 14 are provided in the cross members 6 through which spring pins can be driven to secure the cross members to the lugs 5 of the corner bracket 2.

Figure 4:
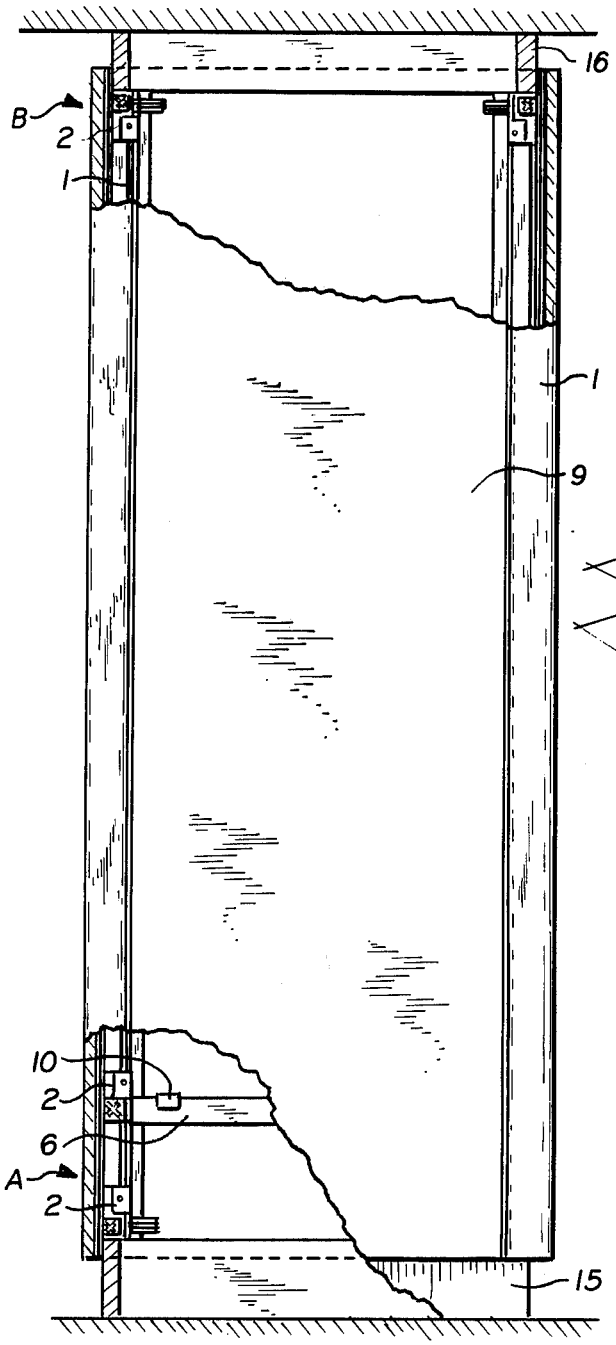
FIG. 4 is a side elevational, partially cutaway view of a pillar provided with a framework in accordance with the invention, with a base and top filler.
Figure 5:
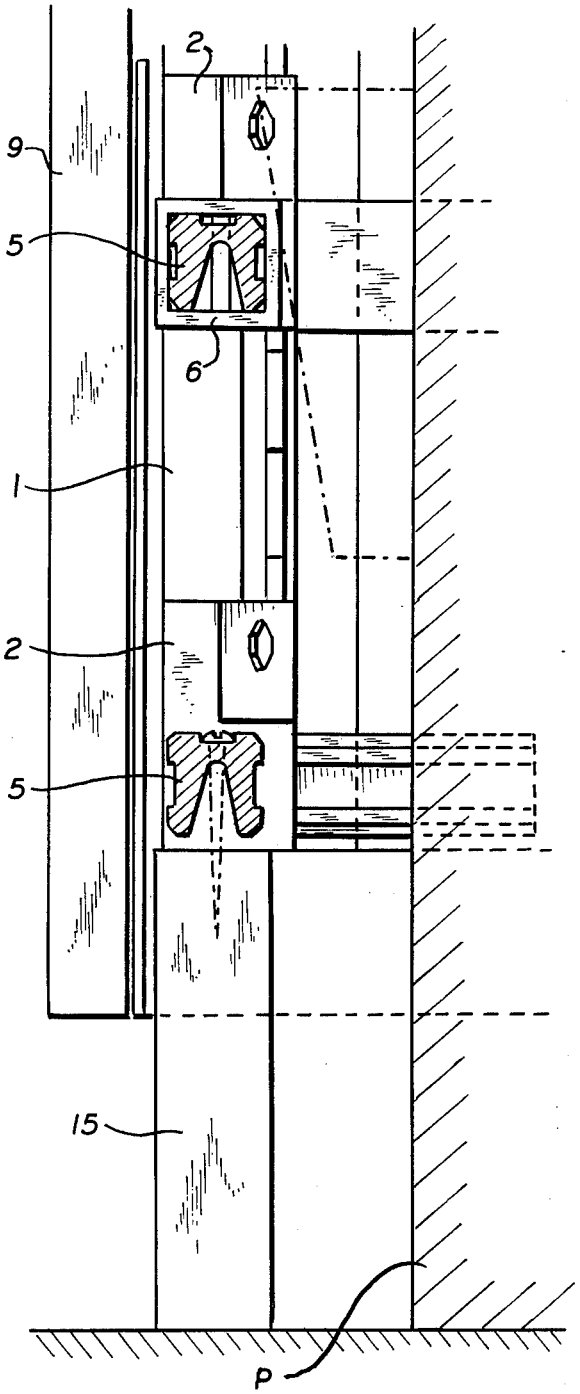
FIG. 5 is an enlarged detail A of FIG. 4.
Figure 6:
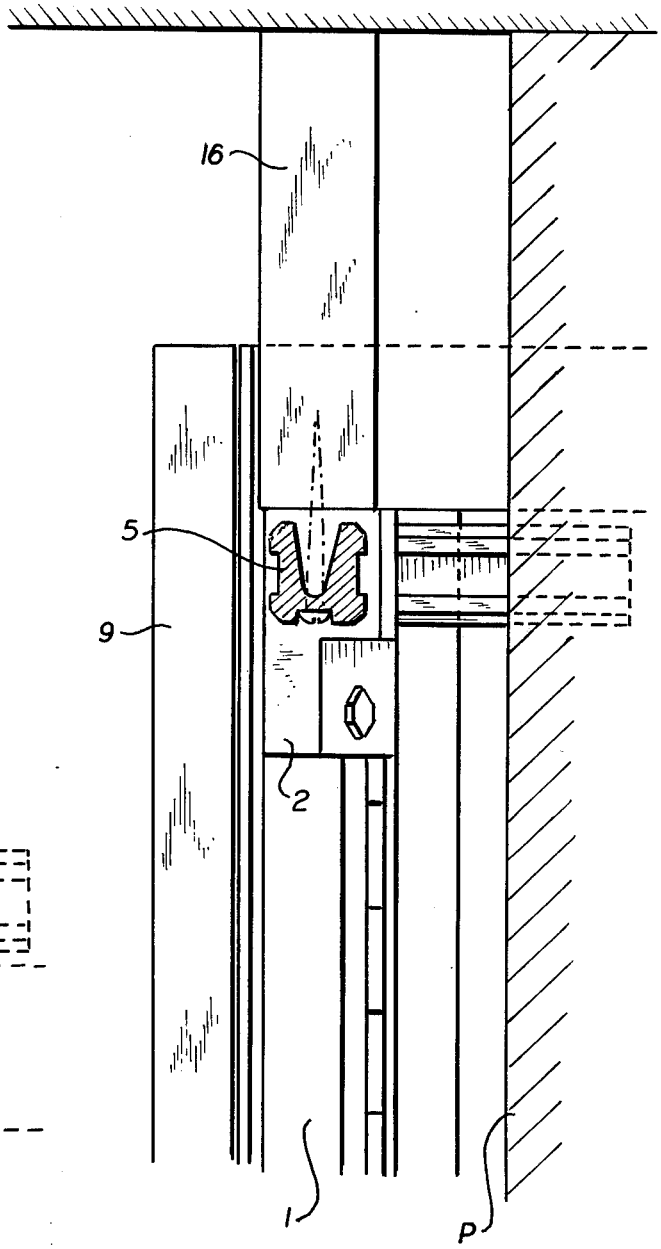
FIG. 6 is an enlarged detail B of FIG. 4.

As shown in FIGS. 4 to 6, a base 15 and a top filler 16 are also provided, both of which consists of boards or the like which are assembled or fitted together on the job to encompass the pillar.

Figure 2:
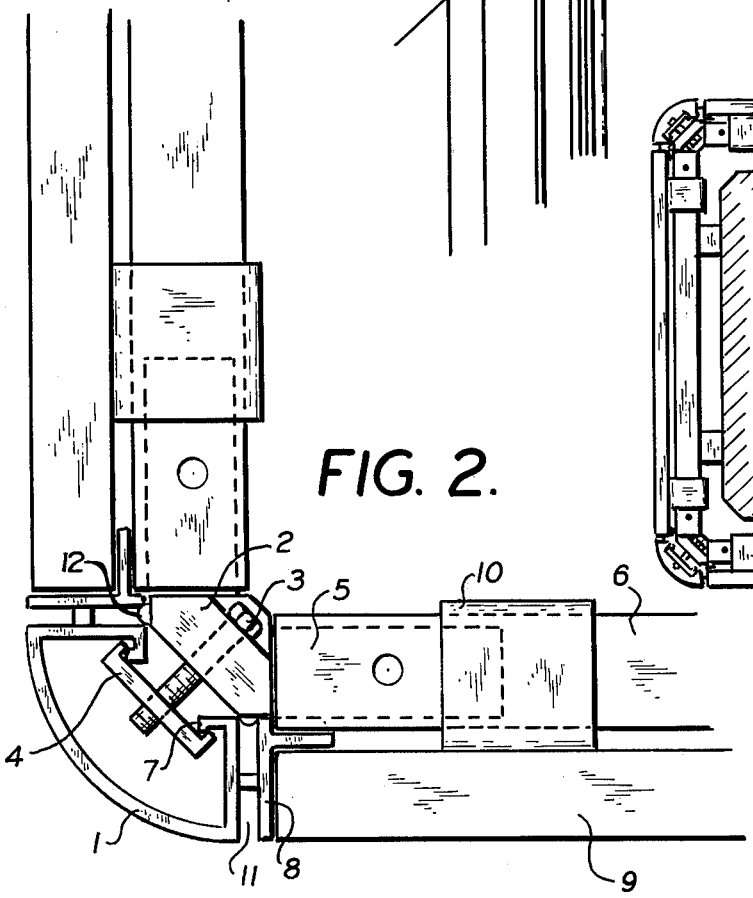
FIG. 2 is a horizontal cross section taken through one corner of the framework of FIG. 1 in the assembled state.
Figure 7:
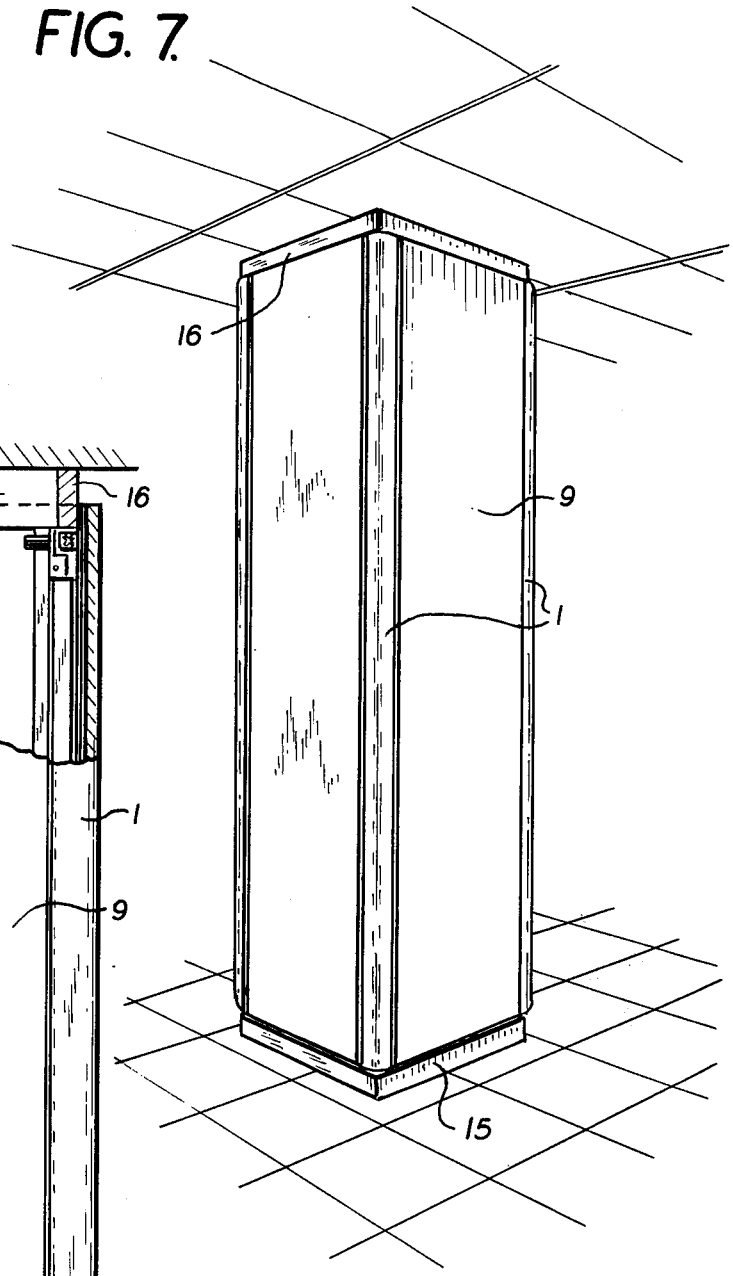
FIG. 7 is a perspective view of a pillar faced in accordance with the invention.

The entire facing including the baseboards and fillers shown in FIGS. 4 to 7 is assembled in the following manner. First, eight corner brackets 2 are mounted in the corner channels to form the upper and lower horizontal frames at the same distance from the bottom and top ends, and they are locked in place by means of bolts 3 in the manner shown in FIGS. 1 and 2. Then an additional corner bracket 2 is temporarily fastened at each end in each corner bracket, and then first the base 15 and the filler 16 are assembled at the point of installation. Then the four corner channels are placed about the base 15 and top filler 16, the latter being pushed down on top of the upper, temporarily attached sliding blocks 2. Then the cross members 6 are fastened to the permanently locked corner brackets 2 to form an upper and lower horizontal frame, and then the sliding blocks temporarily fastened to the corner channels are loosened and the complete framework formed of the corner channels with the sliding blocks and the cross members 6 and surrounding the pillar is placed at the desired elevation. In this position, the lower sliding blocks 2, which are resting on the base 15, and until now have been freely displaceable, are fixed in relation to the corner channels 1 by tightening their bolts 3, thereby placing the elevation of the corner channels and simultaneously that of the cross members. Then the upper filler 16 is raised until it contacts the ceiling, and the upper sliding blocks 2, which until then have been freely displaceable, are fastened in position to hold the top filler by tightening them by means of bolt 3 to the corner channels. Lastly, the facing panels 9 are hung and the facing will be in the state shown in FIG. 7.

The above-described embodiment of the invention can, of course, be modified in many ways without departing from the basic idea of the invention. For example, it would not be necessary to construct the sliding blocks serving for the height adjustment or for the fixation of an upper filler in the form of corner brackets as shown; instead, they could be of a different form, such as a prop-like form, even when, for example, there is no base and the lower sliding blocks are to serve only for a uniform allaround height adjustment of the facing on a floor of uneven height. To simplify the stocking of parts, however, it will be generally desirable to use identical sliding blocks, the use of corner bracket-like sliding blocks offering the additional advantage that they permit additional fastening between the lugs of these corner brackets and the bases and fillers as is indicated by way of example by the screws drawn in broken lines in FIGS. 5 and 6. Also, the fastening of the face panels to the cross members can, of course, be accomplished in any other desired manner.

I claim:

1. A kit having component parts capable of being assembled about a pillar to provide a facing for the pillar comprising:

corner channels for disposition upright and at spaced intervals about the pillar each having two inwardly disposed confronting, spaced longitudinal flanges, and a back plate engaging the longitudinal flanges, of each corner channel, two sliding blocks for being secured to each corner channel by fastening thereof to the back plate of the channel at any desired elevation to provide one set of sliding blocks at a first elevation and a second set of sliding blocks at a second elevation spaced from the first elevation, and means for said fastening of the sliding blocks to the back plates, a set of cross members for each set of sliding blocks joinable with the sliding blocks to provide two frames one at each of said elevations, surrounding the pillar, and facing panels and means for securing the facing panels to the frames for providing said facing for the pillar, the sliding blocks having two lugs for mounting of the cross members on the sliding blocks with the lugs fitting matingly into the ends of the cross members.

2. Kit of claim 1, said corner channels having inwardly disposed longitudinal grooves, the sliding blocks having projections for being received by the grooves for securing the sliding blocks against rotation and defining the angle between the cross members.

3. Kit of claim 1, the lugs and the cross members having bores which are aligned with the cross members mounted on the lugs, and spring pins for disposition in said bores to secure the cross members on the lugs.

4. Kit of claim 1, and a base element for disposition about the pillar between the floor and the facing for the pillar.

5. Kit of claim 4, and a further sliding block for each corner channel for mounting of the facing for the pillar on the base element.

6. Kit of claim 4, and a top filler for disposition about the pillar between the ceiling and the facing for the pillar.

7. Kit of claim 6, and two further sliding blocks for each corner channel for mounting of the facing between the base element and the top filler, with one of said two further sliding blocks resting on the base element and the other to hold the top filler in contact with the ceiling.

8. Kit of claim 1, the facing panels having means for mounting of the face panels on the cross members after the cross members have been jointed to the sliding blocks providing said two frames.

9. Kit of claim 8, the facing panel mounting means being hooks for hanging of the facing panels on the cross members.

10. Kit of claim 7, the facing panels having means for mounting of the face panels on the cross members after the cross members have been jointed to the sliding blocks providing said two frames.

11. Kit of claim 10, the facing panel mounting means being hooks for hanging of the facing panels on the cross members.

* * * * *

UNITED STATES PATENT AND TRADEMARK OFFICE

CERTIFICATE OF CORRECTION

PATENT NO. : 4,034,535

DATED : July 12, 1977

INVENTOR(S) : Heinrich Dustmann

It is certified that error appears in the above-identified patent and that said Letters Patent are hereby corrected as shown below:

Column 4, line 55, (claim 10), change "jointed" to --joined--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*